US007776136B2

(12) United States Patent
Lee et al.

(10) Patent No.: US 7,776,136 B2
(45) Date of Patent: Aug. 17, 2010

(54) APPARATUS FOR MANUFACTURING MOLTEN IRONS BY HOT COMPACTING FINE DIRECT REDUCED IRONS AND CALCINED ADDITIVES AND METHOD USING THE SAME

(75) Inventors: Hoo-Geun Lee, Kyungsangbuk-do (KR); Sung-Kee Shin, Kyungsangbuk-do (KR); Tae-In Kang, Kyungsangbuk-do (KR); Chang-Oh Kang, Kyungsangbuk-do (KR); Kwang-Hee Lee, Kyungsangbuk-do (KR); Sang-Hoon Joo, Kyungsangbuk-do (KR); Sung-Gon Kim, Kyungsangbuk-do (KR); Deuk-Chae Kim, Kyungsangbuk-do (KR)

(73) Assignee: Posco, Pohang-shi (KR)

( * ) Notice: Subject to any disclaimer, the term of this patent is extended or adjusted under 35 U.S.C. 154(b) by 478 days.

(21) Appl. No.: 10/539,743

(22) PCT Filed: Dec. 19, 2003

(86) PCT No.: PCT/KR03/02789

§ 371 (c)(1),
(2), (4) Date: Feb. 13, 2006

(87) PCT Pub. No.: WO2004/057042

PCT Pub. Date: Jul. 8, 2004

(65) Prior Publication Data

US 2006/0162499 A1 Jul. 27, 2006

(30) Foreign Application Priority Data

Dec. 21, 2002 (KR) ..... 10-2002-0082120
Dec. 28, 2002 (KR) ..... 10-2002-0085858

(51) Int. Cl.
*C22B 1/14* (2006.01)
*B30B 9/28* (2006.01)

(52) U.S. Cl. ..... 75/770

(58) Field of Classification Search ..... 75/560–569, 75/746–773

See application file for complete search history.

(56) References Cited

U.S. PATENT DOCUMENTS 3,897,183 A * 7/1975 Hofmann et al. ..... 425/78
(Continued)

FOREIGN PATENT DOCUMENTS

AU 2002301887 B9 * 6/2003
(Continued)

OTHER PUBLICATIONS

Rolling Pressing, in Handbook of Powder Science and Technology, 2nd Ed., edited by M.E. Fayed and L. Otten, 1997, ch. 6, p. 345-363.*

(Continued)

*Primary Examiner*—Roy King
*Assistant Examiner*—Mark L Shevin
(74) *Attorney, Agent, or Firm*—Marshall, Gerstein & Borun LLP

(57) ABSTRACT

A method for manufacturing molten iron including the steps of producing reducing material of mixed hot fine direct reduced iron and calcined additives, the reducing material being produced from multiple fluidized beds; charging the reducing material to at least one pair of roller presses; roll pressing the reducing material through the one pair of roller presses to produce continuous compacted material having protrusions formed on pressed surfaces; crushing the compacted material; charging the crushed compacted material to a coal packed bed; and supplying oxygen to the coal packed bed to manufacture molten iron, wherein in the producing compacted material, the compacted material is formed such that acute and obtuse angles are formed between a center line formed along a length of a cross section that is cut along a lengthwise direction perpendicular to an axial direction of the roller presses and connecting lines that connect grooves closest to each other across the cross sectional area. An apparatus for manufacturing molten iron performs the inventive method for manufacturing molten iron. The processes involved in manufacturing molten iron using the invention are convenient, efficient, improve productivity, and allow for more flexibility with respect to equipment operation during the manufacture of compacted material.

17 Claims, 9 Drawing Sheets

U.S. PATENT DOCUMENTS

| | | | | |
|---|---|---|---|---|
| 4,076,520 | A * | 2/1978 | Pietsch | 419/43 |
| 5,666,638 | A * | 9/1997 | Bergendahl | 419/66 |
| 6,074,456 | A * | 6/2000 | Freytag et al. | 75/436 |
| 6,214,086 | B1 | 4/2001 | Montague et al. | |
| 6,277,324 | B1 * | 8/2001 | Joo et al. | 266/142 |
| 6,352,573 | B2 * | 3/2002 | McClelland et al. | 75/436 |
| 2007/0216072 | A1 * | 9/2007 | Lee et al. | 266/137 |
| 2007/0235909 | A1 * | 10/2007 | Lee et al. | 266/137 |

FOREIGN PATENT DOCUMENTS

| | | |
|---|---|---|
| DE | 101 56 735 | 6/2003 |
| EP | 1 573 076 | 9/2005 |
| KR | 10-2002-49590 | 6/2002 |
| KR | 10 2002 0049590 A | 6/2002 |
| KR | 10-2003-041808 | 5/2003 |
| KR | 10 2003 041808 A | 5/2003 |
| WO | WO-00/36160 | 6/2000 |

OTHER PUBLICATIONS

C.O. Kang, Prospects of Finex Process, Metals 2004, Kokata, India, Nov. 4, 2004, p. 1-12.*

Office action in corresponding Vietnam Application No. 1-2005-1033 dated Jan. 3, 2007.

Office action in corresponding Chinese Application No. 20038017180.3 dated Aug. 11, 2006.

International Search Report in PCT/KR2003/002789 dated Apr. 6, 2004.

International Preliminary Examination Report in PCT/KR2003/002789 dated Feb. 22, 2005.

Hassen et al., "The FINMET Process—A Technology Development Update," *Iron & Steelmaker*, 22(4):35-40 (1993).

Notice of Opposition and papers enclosed (Exhibits E3-E5) for European Patent No. 1 573 076 (Application No. EP 03777476.7), dated Mar. 2, 2009.

Opposition Exhibit E6 for European Patent No. 1 573 076, dated Mar. 19, 2009.

* cited by examiner

APPARATUS FOR MANUFACTURING MOLTEN IRONS BY HOT COMPACTING FINE DIRECT REDUCED IRONS AND CALCINED ADDITIVES AND METHOD USING THE SAME

BACKGROUND OF THE INVENTION (a) Field of the Invention

The invention relates to an apparatus and method for manufacturing molten iron. More particularly, the invention relates to an apparatus and method for manufacturing molten iron in which fine direct reduced iron and calcined additives are supplied to a melter-gasifier after these materials undergo hot compacting to thereby manufacture molten iron.

(b) Description of the Related Art

The iron and steel industry is a core industry that supplies the basic materials needed in construction and in the manufacture of automobiles, ships, home appliances, and many of the other products we use. It is also an industry with one of the longest histories that has progressed together with humanity. In an iron foundry, which plays a pivotal roll in the iron and steel industry, after molten iron (i.e., pig iron in a molten state) is produced using iron ore and coal as raw materials, steel is produced from the molten iron then supplied to customers.

Approximately 60% of the world's iron production is realized using the blast furnace method developed in the 14th century. In the blast furnace method, coke produced using as raw materials iron ore and bituminous coal that have undergone a sintering process are placed in a blast furnace, and oxygen is supplied to the furnace to reduce the iron ore to iron to thereby manufacture molten iron. The blast furnace method, which is a main aspect of molten iron production, requires raw materials having a hardness of at least a predetermined level and grain size that can ensure ventilation in the furnace. As a carbon source used as fuel and a reducing agent, specific raw coal depends on coke that has undergone processing, and as an iron source, there is a dependence primarily on sintered ore that has undergone a successive compacting process. Accordingly, in the modern blast furnace method, it is necessary to include raw material preparation processing equipment such as coke manufacturing equipment and sintering equipment, and not only is it necessary to obtain accessory equipment in addition to the blast furnace, but equipment to prevent and minimize the generation of pollution in the accessory equipment is needed. The amount of investment, therefore, is considerable, ultimately increasing manufacturing costs.

In order to solve these problems of the blast furnace method, significant effort is being put forth in iron foundries all over the world to develop a smelting reduction process that produces molten iron by directly using common coal as fuel and a reducing agent, and also directly using fine ores, which make up over 80% of the world's ore production, as an iron source.

U.S. Pat. No. 5,534,046 discloses an apparatus for manufacturing molten iron that directly uses common coal and fine ores. FIG. 9 shows a simplified version of an apparatus for manufacturing molten iron disclosed in U.S. Pat. No. 5,534,046. As shown in FIG. 9, a conventional molten iron manufacturing apparatus 900 includes three fluidized-bed reactors 910 in which fluidized beds are formed, and a melter-gasifier 960 connected thereto. Fine ores and additives at room temperature are charged in the first fluidized-bed reactor, then sequentially passed through all three of the fluidized-bed reactors 910. Since high temperature reducing gas is supplied to the three fluidized-bed reactors 910 from the melter-gasifier 960, the fine ores and additives increase in temperature as a result of the contact made with the high temperature reducing gas. At the same time, 90% or more of the fine ores and additives at room temperature is reduced, and 30% or more of the same is calcined then charged into the melter-gasifier 960.

Coal is supplied to the melter-gasifier 960 to form a coal packed bed, and the fine ores and additives at room temperature undergo fusion and slagging in the coal packed bed to be exhausted as molten iron and slag. Oxygen is supplied through a plurality of tuyeres mounted to an outer wall of the melter-gasifier 960 such that the coal packed bed is burned and converted into high temperature reducing gas, after which the high temperature reducing gas is supplied to the fluidized-bed reactors 910. Following reduction of the fine ores and additives at room temperature, they are exhausted outside.

However, in the molten iron manufacturing apparatus 900 described above, a high speed gas stream is formed to an upper end of the melter-gasifier 960 such that the fine direct reduced iron and the calcined additives charged in the melter-gasifier 960 undergo scattering loss. Furthermore, in the case where the fine direct reduced iron and the calcined additives are charged in the melter-gasifier 960, it is difficult to ensure that the coal packed bed in the melter-gasifier 960 is able to be ventilated and can flow freely.

To overcome this problem, there is being researched a method in which fine direct reduced iron and calcined additives are hot compacted and charged in a melter-gasifier. As an example, a method and apparatus for manufacturing elliptical sponge iron briquettes are disclosed in U.S. Pat. No. 5,666,638. Also, U.S. Pat. Nos. 4,093,455, 4,076,520, and 4,033,559 disclose a method and apparatus for manufacturing plate-shaped and corrugated irregular sponge briquettes. Such sponge briquettes are realized by hot compacting fine direct reduced iron then cooling the same to obtain a density of 5 tons/$m^3$ such that the sponge briquettes are suitable for long distance transportation.

However, if compacted material with a high density as described above is charged into a melter-gasifier, a melting point of reduced iron that is melted in the coal packed bed in the melter-gasifier is increased. This increases the amount of fuel needed for melting of the reduced iron to thereby increase energy consumption.

Further, since pressing is performed at high pressures for the purposes of long distance transportation, the roller presses are easily worn. Accordingly, production costs are increased by the rise in equipment expenses.

In addition, in the case where fine direct reduced iron is compacted to a plate or corrugated irregular shape, the compacted material becomes split apart along its length if formation is to at least a predetermined thickness. In this case, since a flattened shape results after the compacted material is made thinner and crushed, when charged in the melter-gasifier, the compacted material is densely packed such that the ventilation in the melter-gasifier is reduced.

Finally, in the case where fine direct reduced iron is roll pressed, it is necessary to increase the amount of fine direct reduced iron that is charged to enhance productivity. This increases the thickness of the compacted material such that it is not continuously formed and instead is interrupted. As a result, the reduction speed of the plate-shaped compacted material is increased such that it passes through a first crusher in a state of not having been crushed. Therefore, much assembled compacted material is produced such that significant stress is given to a second crusher. Further, in the case where the compacted material that is crushed is increased in the second crusher, the amount of powder produced is increased during crushing such that ventilation during charging in the melter-gasifier is deteriorated.

SUMMARY OF THE INVENTION

The invention has been made in an effort to solve the above problems. The present invention provides an apparatus and method for manufacturing molten iron in which fine direct reduced iron and calcined additives are used after undergoing hot compacting.

It is an object of the invention to manufacture compacted material in such a manner that it is continuously formed without breaks or being split apart and the amount of powder produced is reduced.

To achieve this object, the invention provides a method for manufacturing molten iron includes producing reducing material of mixed hot fine direct reduced iron and calcined additives, the reducing material being produced from multiple fluidized beds; charging the reducing material to at least one pair of roller presses; roll pressing the reducing material through the one pair of roller presses to produce continuous compacted material having protrusions formed on pressed surfaces; crushing the compacted material; charging the crushed compacted material to a coal packed bed; and supplying oxygen to the coal packed bed to manufacture molten iron, wherein in the producing compacted material, the compacted material is formed such that acute and obtuse angles are formed between a center line formed along a length of a cross section that is cut along a lengthwise direction perpendicular to an axial direction of the roller presses and connecting lines that connect grooves closest to each other across the cross sectional area.

In the charging the reducing material, the reducing material is preferably charged in two slanted directions at acute angles to a direction perpendicular to the roller presses.

Preferably, in the producing the compacted material, the produced compacted material has a thickness of 3~30 mm and a density of 3.5~4.2 tons/$m^3$.

Further, in the crushing the compacted material, an average grain size of the compacted material is preferably 50 mm or less, and crushing is performed to irregular shapes.

The method may further include bypassing the crushed compacted material; cooling the bypassed compacted material; and storing the cooled compacted material.

The method may further include performing another crushing process of the crushed compacted material in the case where an average grain size of the crushed compacted material exceeds 30 mm.

In addition, the method may further include supplying nitrogen in each step.

The method may also include collecting dust particles generated in each step; wet scrubbing the collected dust particles; removing moisture from the wet scrubbed dust particles; and discharging the dust particles from which moisture has been removed to the outside.

A method for manufacturing molten iron includes producing hot fine direct reduced iron from fluidized beds; charging the fine direct reduced iron to at least one pair of roller presses; roll pressing the fine directed reduced iron through the one pair of roller presses to produce continuous compacted material having protrusions formed on pressed surfaces; crushing the compacted material; charging the crushed compacted material to a coal packed bed; and supplying oxygen to the coal packed bed to manufacture molten iron, wherein in the producing compacted material, from a cross section where the compacted material is cut along a lengthwise direction thereof that is perpendicular to an axial direction of the roller presses, a groove of a second surface is positioned between two adjacent grooves of a first surface.

Preferably, a ratio of an arc length between a corresponding point of the first surface corresponding to a groove of the second surface and at least one of adjacent grooves of the first surface, to an arc length between the adjacent grooves of the first surface is between 0.3 and 0.5.

The method may further include mixing hot calcined additives from multiple fluidized beds with the fine direct reduced iron and performing each step.

Preferably, the calcined additives are 3~20 wt % of the total compacted material.

In the producing the compacted material, the fine direct molten iron is preferably roll pressed at a temperature of 400~800° C. by the one pair of roller presses.

In the producing the compacted material, the fine direct molten iron may be roll pressed to 140~250 bar by the one pair of roller presses.

Preferably, in the producing the compacted material, the produced compacted material has a thickness of 3~30 mm and a density of 3.5~4.2 tons/$m^3$.

In the crushing the compacted material, an average grain size of the compacted material may be 50 mm or less, and crushing may be performed to irregular shapes.

Preferably, the average grain size of the compacted material is 30 mm or less.

Preferably, in the charging the crushed compacted material to a coal packed bed, the compacted material with a grain size of 1~30 mm is 25~100 wt % of the total.

An apparatus for manufacturing molten iron includes a charge container receiving the supply of reducing material in which hot fine direct reduced iron and calcined additives from multiple fluidized-bed reactors are mixed; at least one pair of roller presses to which the fine direct reduced iron is supplied to undergo roll pressing, thereby producing continuous compacted material; a crusher crushing the compacted material produced by the roller presses; and a melter-gasifier to which is charged crushed compacted material that is crushed by the crusher, wherein concave grooves are uniformly and continuously formed along an axial direction of the at least one pair of roller presses on an outer surface thereof, and protrusions are formed between adjacent concave grooves along a circumferential direction of the roller presses; and wherein the at least one pair of roller presses are formed such that a protrusion of a second roller press is positioned between two adjacent protrusions of a first roller press during production of the compacted material.

Preferably, the charge container includes a hollow chamber positioned above an area corresponding to between the roller presses; intake pipes connected to an upper portion of the hollow chamber and that supplies reducing material thereto; and charge members mounted to both sides of the intake pipes making an acute angle with a vertical direction of the roller presses, and that are rotatably driven in this state such that reducing material in the hollow chamber is charged to the roller presses.

The apparatus may further include a cooler for bypassing the crushed compacted material and cooling the same with water; and a storage tank for transporting and storing the compacted material cooled by the cooler.

The cooler may include a first conveyor that receives the crushed compacted material and submerges the compacted material in water to cool the same, then transmits the cooled compacted material to the storage tank; and a second conveyor on which are mounted a plurality of blades that collect crushed compacted material powder that has collected on the floor, and supply the powder to the storage tank.

The apparatus may further include a hot separator for separating compacted material among the crushed compacted material with a grain size of 30 mm or more; and an additional crusher for re-crushing the compacted material selected by the hot separator.

The apparatus may also further include a nitrogen supply device for supplying nitrogen to the roller presses, the first crusher, and the second crusher.

Preferably, the roller presses are operated such that a ratio of an arc length between a corresponding point of the first roller press corresponding to a tip of protrusion of the second roller press and at least one tip of protrusion of the first roller press, to an arc length between the tips of adjacent protrusions of the first roller press, is between 0.3 and 0.5.

Preferably, the roller presses further include a hydraulic press unit, and the first roller press undergoes rotation in a stationary position while the second roller press may be varied in position to adjust an interval with the first roller press by the hydraulic press unit.

The apparatus may further include a dust collecting port collecting dust particles generated in the charge container, and by the roller presses and the crusher; a wet scrubber for wet scrubbing dust particles collected at the dust collecting port; and a dehumidifier for removing the moisture from the dust particles that are wet scrubbed by the wet scrubber.

Preferably, the compacted material produced by the roller presses has a thickness of 3~30 mm and a density of 3.5~4.2 tons/$m^3$.

Preferably, an average grain size of the crushed compacted material is 50 mm or less, and crushing is performed to irregular shapes.

BRIEF DESCRIPTION OF THE DRAWINGS

The accompanying drawings, which together with the specification, illustrate exemplary embodiments of the present invention, and, together with the description, serve to explain the principles of the invention.

DETAILED DESCRIPTION OF THE INVENTION

Preferred embodiments of the invention will now be described in detail with reference to the accompanying drawings. It should be clearly understood that many variations and/or modifications of the basic inventive concepts may appear to those skilled in the present art. The embodiments are to be regarded as illustrative in nature, and not restrictive.

Figure 1:
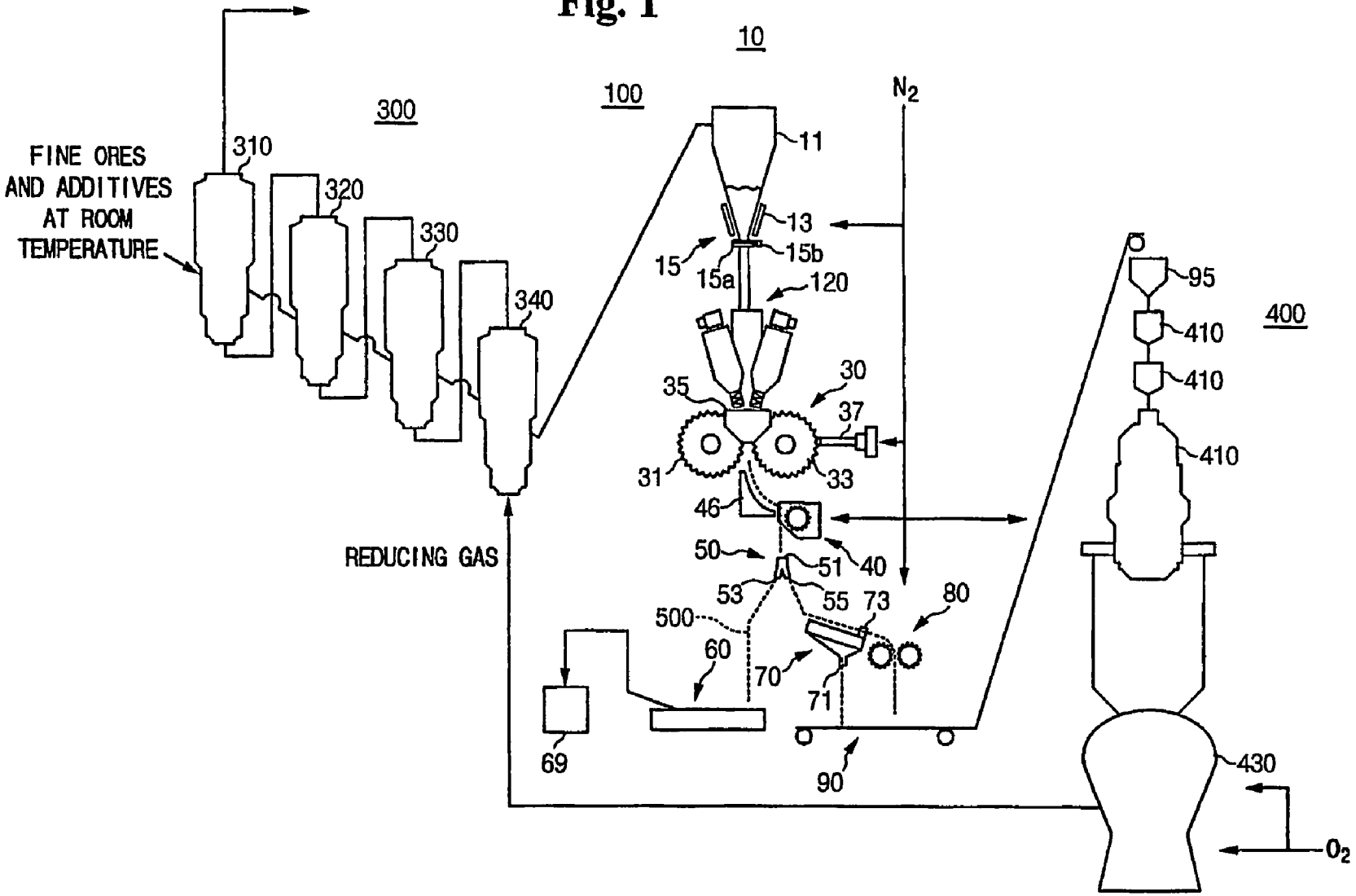
FIG. 1 is a schematic view of an apparatus for manufacturing molten iron according to an embodiment of the invention.

FIG. 1 is a schematic view of an apparatus for manufacturing molten iron according to an embodiment of the present invention. A hot compacting assembly 100 of a molten iron manufacturing apparatus 10 of FIG. 1 is enlarged to allow for better description thereof.

The molten iron manufacturing apparatus 10 includes a hot compacting assembly 100, a fluidized-bed reactor unit 300, and a melter-gasifier assembly 400. The fluidized-bed reactor unit 300 includes multiple stages of fluidized-bed reactors having fluidized beds. In FIG. 1, an example is shown in which the fluidized-bed reactor unit 300 has four fluidized-bed reactors. However, the invention is not limited to this number of fluidized-bed reactors. The four fluidized-bed reactors include a first pre-heating furnace 310, a second pre-heating furnace 320, a preliminary reducing furnace 330, and a final reducing furnace 340. The four fluidized-bed reactors reduce and calcine fine ores and additives at room temperature using reducing gas supplied from a melter-gasifier 430 to manufacture a mixed reducing material, and supply the same to the hot compacting assembly 100. The hot compacting assembly 100 roll presses and crushes the reducing material to manufacture compacted material. The hot compacting assembly 100 then supplies the compacted material to the melter-gasifier assembly 400.

The hot compacting assembly 100 according to the embodiment of the invention includes the basic elements of a charge container 20, a pair of roller presses 30, and a first crusher 40. The hot compacting assembly 100 also includes a hot storage container 11, a cooler 60, a storage tank 69, a branching unit 50, a hot separator 70, a second crusher 80, and a hot conveying unit 90. The hot compacting assembly 100 according to the embodiment of the present invention may also include other elements as needed.

The elements comprising the hot compacting assembly 100 will now be described in detail.

A reducing material of mixed fine direct reduced iron and calcined additives of 700° C. or greater and a volumetric density of 2 tons/$m^3$ is transferred to and stored in the hot storage container 11. Since an exhaust pressure of the final reducing furnace 340 is 3 bar and a flow rate is 3000 $m^3$/h, hot fine direct reduced iron and calcined additives are transferred under pressure. It is possible to use only the hot fine direct reduced iron without using the calcined additives. However, it is preferable that calcined additives are mixed with hot fine direct reduced iron to 3~20 wt % of the total in order to prevent the hot fine direct reduced iron from easily breaking down in the melter-gasifier.

The hot storage container 11 includes a level control device 13 mounted to a lower side surface thereof. The level control device 13 detects a level of a reducing material stored in the hot storage container 11, and if a predetermined level is reached, transfer of reducing material from the fluidized-bed reactor is discontinued.

An open/close valve 15 is mounted to a lower end of the hot storage container 11. The open/close valve 15 includes an open/close plate 15*a* for opening and closing the lower end of the hot storage container 11, and a hydraulic actuator 15*b* for controlling the open/close plate 15*a*.

The charge container 20 is mounted under the hot storage container 11. The charge container 20 receives the supply of reducing material from the hot storage container 11. Further, the charge container 20 receives the supply of reducing material when the open/close valve 15 is open, and forcefully charges the reducing material to roller presses by driving an electric motor. The charge container 20 is described in more detail with reference to FIG. 2.

Figure 2:
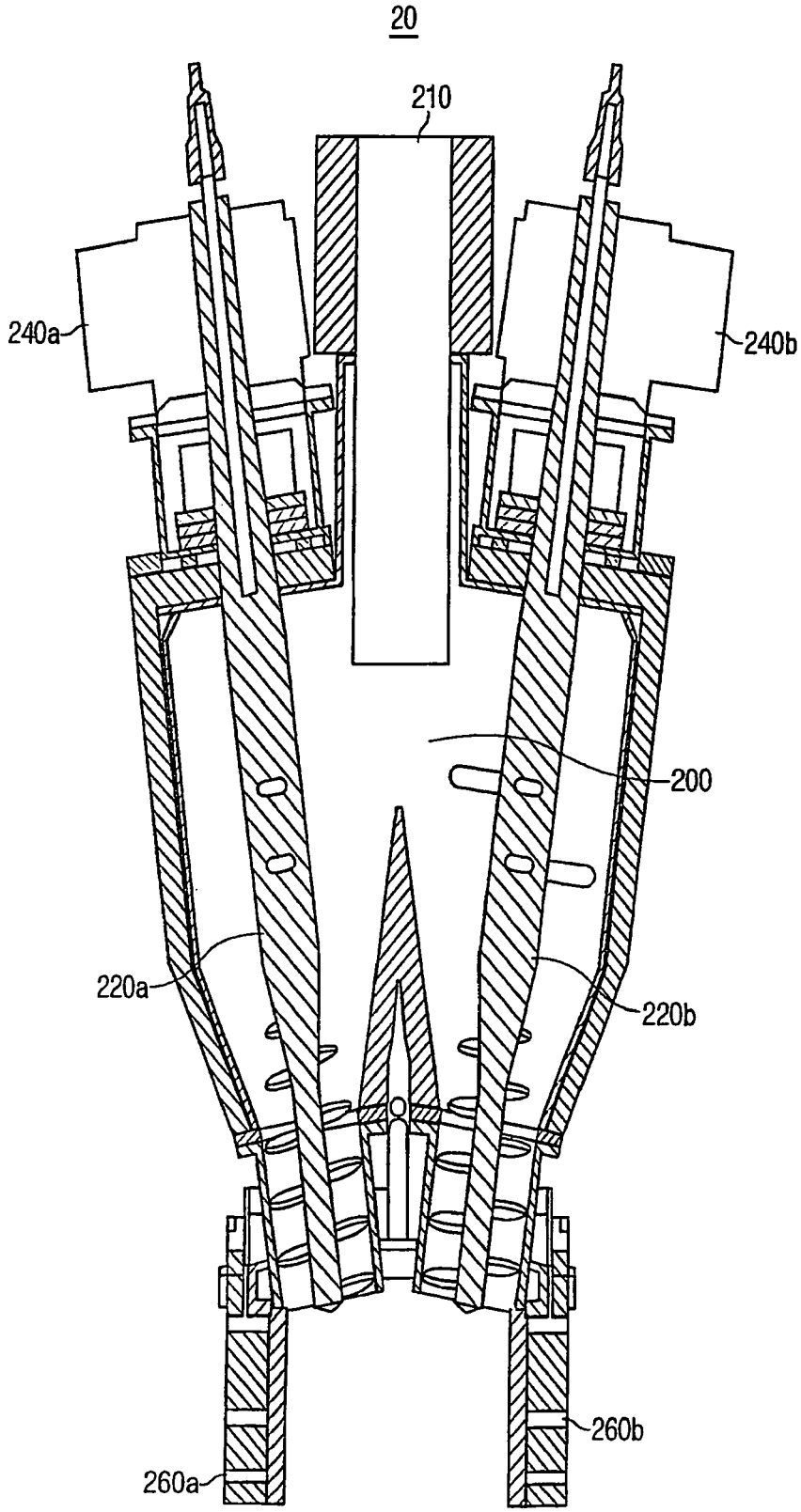
FIG. 2 is a sectional view of a charge container according to an embodiment of the invention.

FIG. 2 is a sectional view of the charge container 20 according to an embodiment of the invention, and shows a cross section of the charge container 20 when cut along the direction reducing material is charged.

The charge container 20 defines a hollow chamber 200 therein. An intake pipe 210 is connected to an upper portion of the hollow chamber 200 and supplies reducing material. Also, charge members 220*a* and 220*b* are mounted to both sides of the intake pipe 210 making an acute angle with a vertical direction, and are rotatably driven in this state such that reducing materials in the hollow chamber 200 are forcefully supplied to lower roller presses. In FIG. 2, although two charge members are shown, such a configuration is used for illustrative purposes only and the present invention is not limited in this regard. Further, since reducing materials are forcefully charged to roller presses from two directions that are slanted at an acute angle from the vertical direction, the amount of reducing material that is scattered or leaked out can be minimized, and identical amounts of the reducing material can be charged.

The charge container 20 may vary the amount of reducing material that is charged to up to 60 tons per hour. The charge members 220*a* and 220*b* are screw-shaped. Electric motors 240*a* and 240*b* to rotatably drive the charge members 220*a* and 220*b*, respectively, are mounted to upper areas thereof, and screw-type configurations are formed at lower areas of the charge members 220*a* and 220*b*. The charge members 220*a* and 220*b* are made of a material highly resistant to high temperatures to thereby minimize resistance in high temperature conditions. Further, leakage preventing units 260*a* and 260*b* prevent reducing material from escaping through upper side surfaces when a pair of roller presses positioned at a lower area rotate.

Referring back to FIG. 1, at least a pair of roller presses 30 are mounted to a lower end of the charged container 20. The roller presses 30 roll press the reducing material into continuous compacted material. The number of roller presses 30 shown is illustrative only, and the invention is not limited in this regard. Hence, more than two roller presses may be mounted.

The reducing materials are charged into the roller presses 30 from the charge container 20, and the roller presses 30 roll press the reducing material and produce continuous compacted material with protrusions formed on both pressed sides. The roller presses 30 perform roll pressing of the reducing material by rotating in opposite directions. It is preferable that the reducing material, which includes fine direct reduced iron, is roll pressed to 140~250 bar at a temperature of 400~800° C.

Although not shown in FIG. 1, a first roller press 31 and a second roller press 33 are each connected to a hydraulic motor to be rotatably driven by the same. A hydraulic press unit 37 is mounted to the roller presses 30, and acts to vary a distance between the first roller press 31 and the second roller press 33 during rotation of the same. A thickness of the compacted material is varied by this operation. The distance may be varied horizontally. That is, the first roller press 31 undergoes rotation in a stationary position, while the second roller press 33 may be varied in position horizontally while undergoing rotation by the hydraulic press unit 37. It is also possible to switch this operation between the first roller press 31 and the second roller press 33. A slip-preventing layer 35 is mounted between the roller presses 30 to prevent the roll-pressed compacted material from escaping out of the side of the roller presses 30.

Although not shown in FIG. 1, the roller presses 30 each include a main shaft that is connected to the hydraulic motors and roll tires that surround the main shaft. During roll pressing, coolant is passed through an inner area of the main shafts to cool the roller presses 30. Further, concave grooves are uniformly and continuously formed along an axial direction of the roller presses 30 on an outer surface of the roll tires, that is, on an outer surface of the roller presses 30. Accordingly, protrusions are formed between adjacent concave grooves along a circumferential direction of the roller presses 30. The surface of the roller presses 30 is made of a material that can maximally prevent wear in high temperature conditions.

A length of the concave grooves along the rotational direction of approximately 1~5 mm is suitable, and a vertical length from protrusions to a deepest point of the concave grooves of approximately 3~15 mm is appropriate. Also, a distance between adjacent protrusions of approximately 20~50 mm is suitable.

Figure 3:
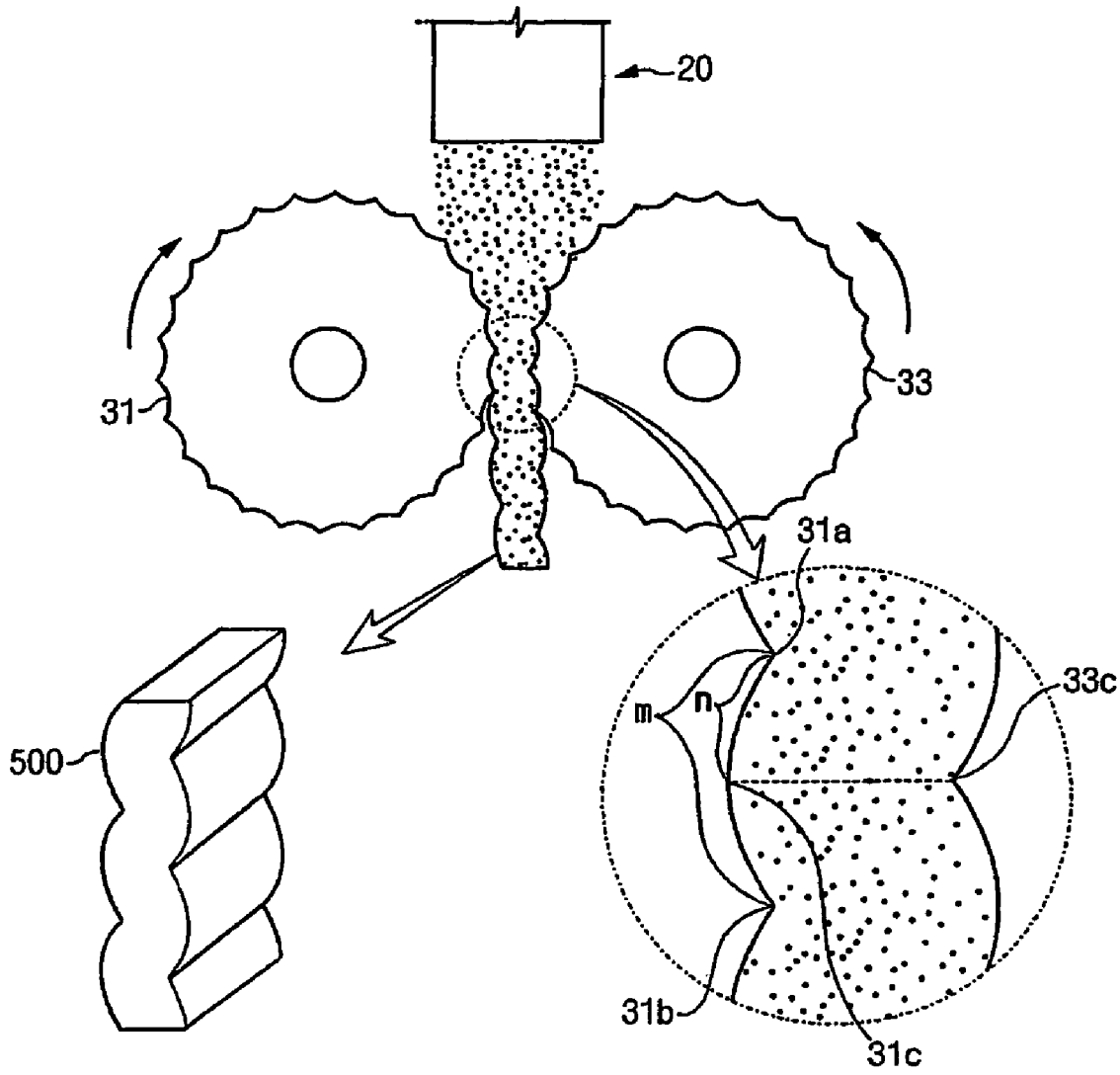
FIG. 3 is a drawing schematically showing roller presses and compacted material formed by the same according to an embodiment of the invention.

A more detailed description of the surfaces of the roller presses will be provided with reference to FIG. 3.

FIG. 3 is a drawing schematically showing roller presses and compacted material formed by the same according to an embodiment of the invention.

As shown in FIG. 3, when producing compacted material, a pair of the roller presses 30 is operated in a state where the protrusions of the second roller presses 33 are between the adjacent protrusions on the surface of the first roller press 31. For example, a protrusion 33*c* of the second roller press 33 is positioned between adjacent protrusions 31*a* and 31*b* of the first roller press 31. With this configuration, compacted material 500 that is continuous and has grooves that are unaligned from one side to the other may be formed.

Further, in the embodiment of the invention, it is preferable to operate the roller press in order to be a specific ratio of an arc length between a corresponding point of the first roller press 31 corresponding to a tip of a protrusion of the second roller press 33 and at least one tip of protrusion of the first roller press 31, to an arc length between the tips of adjacent protrusions of the first roller press 31, is between 0.3 and 0.5. That is, with reference to the enlarged circle of FIG. 3, m is an arc length between the tips of the adjacent protrusions 31*a* and 31*b* of the first roller press 31, and n is an arc length from one of the tips of the adjacent protrusions 31*a* and 31*b* to a point 31*c* on the first roller press 31 across from where there is positioned a tip of a protrusion 33*c* of the second roller press 33 corresponding to between the tips of the adjacent protrusions 31*a* and 31*b*. With the variables m and n set in this manner, it is preferable that a ratio n/m is between 0.3 and 0.5. In FIG. 3, the arc length n is shown as the distance between the tip of the protrusion 31*a* and the corresponding point 31*c*. However, the arc length n may just as easily be the distance between the tip of the protrusion 31*b* and the corresponding point 31*c*.

The tip of the protrusion 33*c* of the second roller press 33 is positioned between the tips of the protrusions 31*a* and 31*b* of the first roller press 31 and moves therebetween. As a result, the ratio of 0.3 to 0.5 is essentially the same as the ratio of between 0.5 and 0.7. If the ratio n/m is less than 0.3, both protrusions on the pressed surfaces come to be adjacent such that a thickness of the compacted material is excessively reduced. This may result in the breaking of the compacted material.

Figure 4:
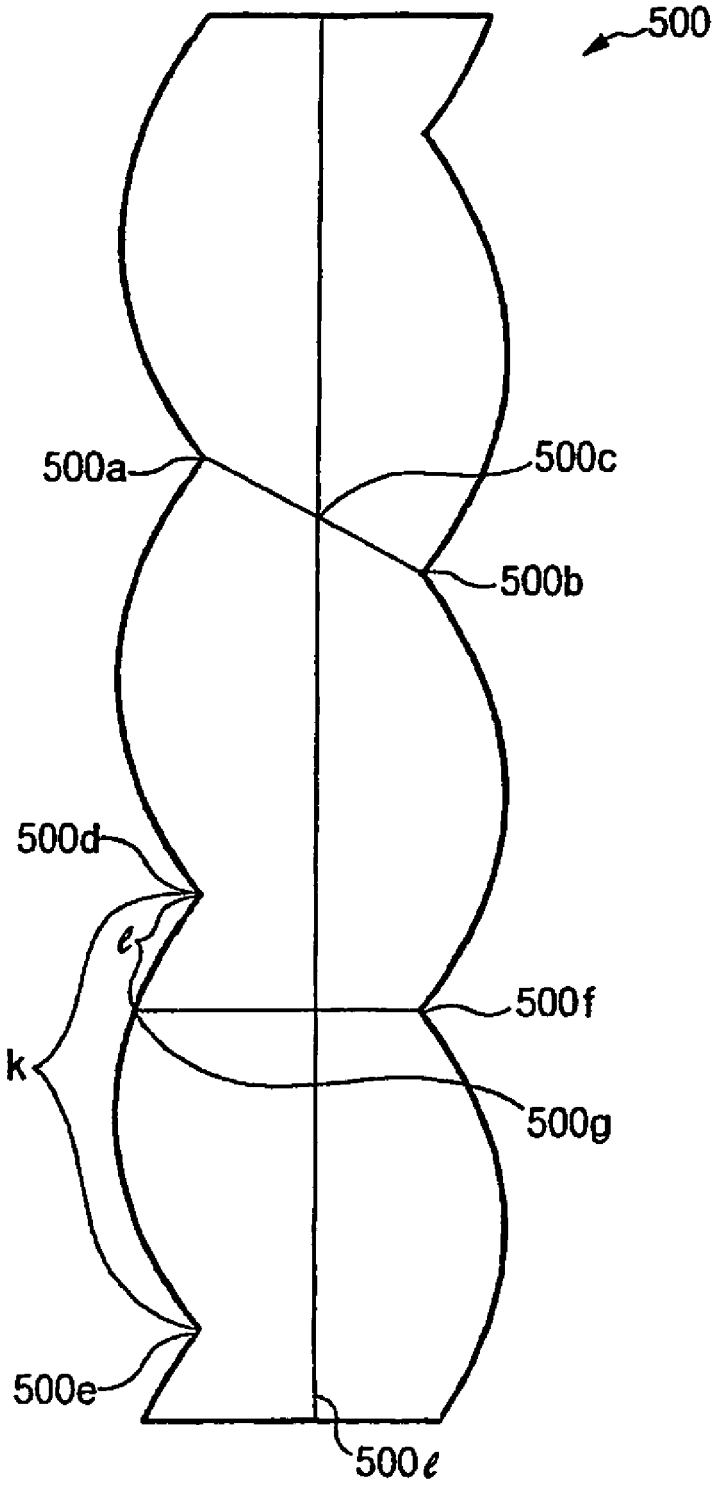
FIG. 4 is a sectional view of compacted material manufactured according to an embodiment of the invention.

A cross sectional formation of compacted material manufactured using roller presses as described above will be described with reference to FIG. 4. FIG. 4 is a sectional view of the compacted material 500 manufactured according to an embodiment of the invention, in which a cross section of the compacted material 500 is taken along a lengthwise direction thereof that is a direction perpendicular to an axial direction of the roller presses.

The compacted material 500 according to the present invention is formed such that acute and obtuse angles are formed between a center line, which is formed along a length of the cross section cut along a lengthwise direction perpendicular to the axial direction of the roller presses, and connecting lines that connect grooves closest to each other across the cross sectional area. For example, a center line 500*l* shown in FIG. 4 and a connecting line that connects two grooves 500*a* and 500*b* closest to each other across the cross sectional area form acute and obtuse angles where they intersect the center line 500*l* at an intersection point 500*c*.

Further, in the compacted material 500 according to the invention, if one of the pressed surfaces is referred to as a first surface and the other of the pressed surfaces is referred to as a second surface, grooves of the second surface are positioned between adjacent grooves of the first surface with respect to the cross section that is cut along a lengthwise direction perpendicular to the axial direction of the roller presses. For example, as shown in FIG. 4, a groove 500*f* of the second surface is positioned between adjacent grooves 500*d* and 500*e* of the first surface.

In addition, the compacted material 500 manufactured according to the invention is formed such that a ratio of an arc length between corresponding point of the first surface corresponding to a groove of the second surface and at least one groove of the adjacent grooves of the first surface, to an arc length between adjacent grooves of the first surface is between 0.3 and 0.5. For example, with reference to FIG. 4, if an arc length between the grooves 500*d* and 500*e* is k, and an arc length between a corresponding point 500*g* of the first surface across from the groove 500*f* of the second surface and one of the groove 500*d* of the first surface is 1, then the ratio 1/k is 0.3 to 0.5. The same ratio holds for when the groove 500*e* of the first surface is used. If the ratio 1/k is less than 0.3, both groove on the pressed surfaces come to be adjacent such that a thickness of the compacted material is excessively reduced. This may result in the breaking of the compacted material.

In the invention, a thickness of the compacted material manufactured by operating the roller presses is 3~30 mm, and a density thereof is 3.5~4.2 tons/$m^3$. If the thickness of the compacted material is less than 3 mm, it is possible for the same to break, while if greater than 30 mm the surface of the roller presses may become damaged as a result of the excessive size of the material passed therethrough. The compacted material is therefore manufactured to within this range of thicknesses. Further, since the compacted material is directly used in the melter-gasifier, a density of 3.5~4.2 tons/$m^3$ of the compacted material ensures a sufficient level for transfer and a level that is not excessive for the pressure applied thereto by the roller presses during roller pressing such that there is only limited concern of damage to the roller presses. In a subsequent step, the roll pressed compacted material is crushed into predetermined sizes.

Referring again to FIG. 1, the first crusher 40 is mounted under the roller presses 30. The first crusher 40 is a device for performing a primary separation/crushing operation of the compacted material formed by the roller presses 30 to a size enabling charging into the melter-gasifier 430. The first crusher 40 is described in more detail with reference to FIG. 5.

Figure 5:
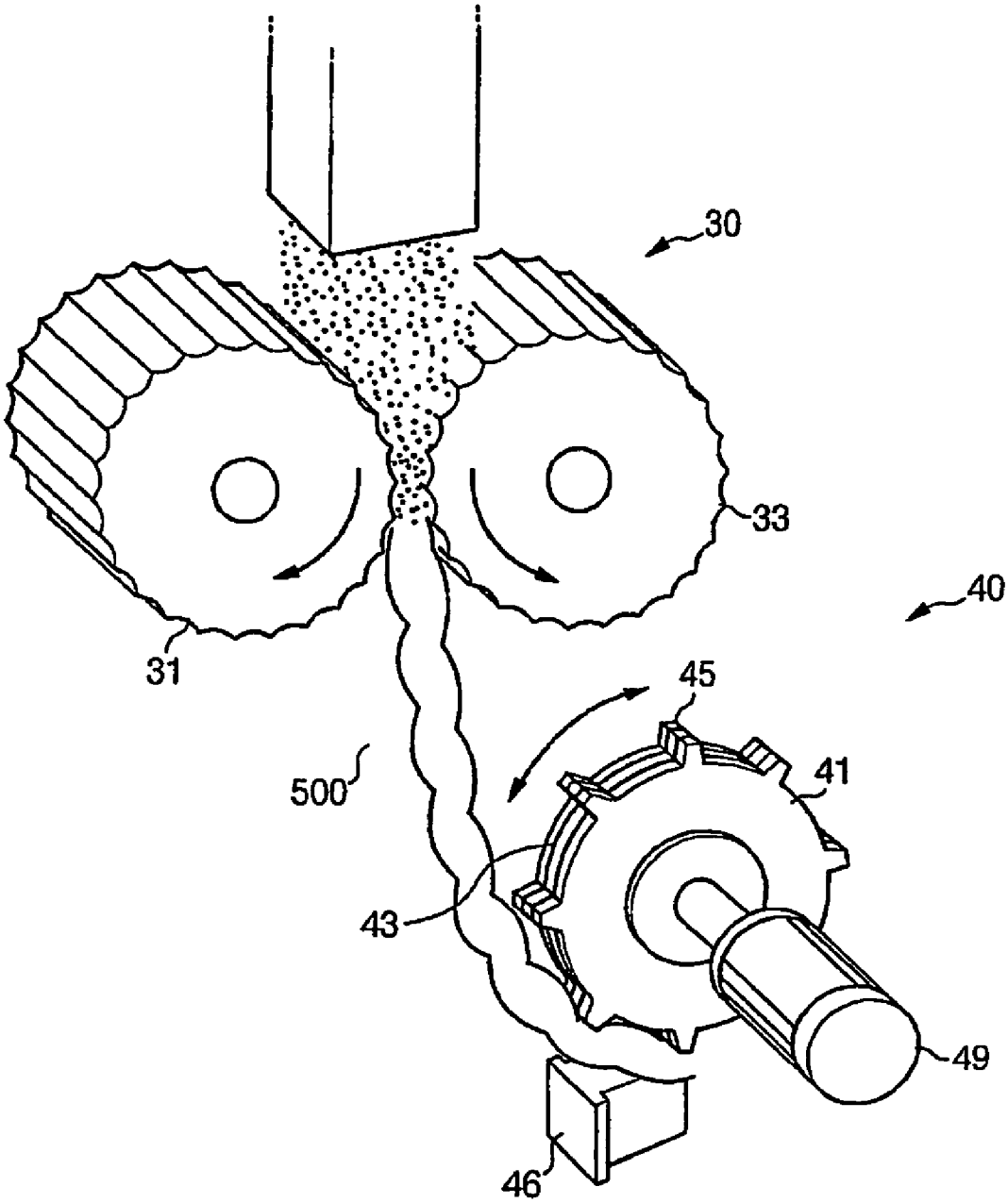
FIG. 5 is a drawing schematically showing an operation of roller presses and a first crusher according to an embodiment of the invention.

FIG. 5 is a drawing schematically showing an operation of roller presses and a first crusher according to an embodiment of the present invention.

The roll pressed compacted material 500 is continuously formed and supplied from the roller presses 30, then is crushed in the first crusher 40. A support 46 guides the compacted material 500 toward the first crusher 40, and supports the first crusher 40 during crushing of the compacted material 500. The first crusher 40 is connected to a rotating axle of a hydraulic motor 49, and operates such that a plurality of crushing plates 41 delivers a pulverizing force to the compacted material to crush the same spacer rings 43 are interposed between the crushing plates 41 to thereby adjust a gap between the crushing plates 41. Further, the crushing plates 41 include a plurality of pointed protrusions 45 such that impacts caused by inertial force during rotation of the crushing plates 41 separate and crush the compacted material 500. When crushed by the first crusher 40, an average grain size of the compacted material is 50 mm or less. Preferably, the average grain size is 30 mm or less as this is more suitable for use in the melter-gasifier, and the particles are irregularly shaped.

Referring again to FIG. 1, a hot branching unit 50 is mounted below the first crusher 40. The hot branching unit 50 performs a branching operation on the crushed hot compacted material to supply the same for cooling and storage or to the melter-gasifier. In FIG. 1, the hot branching unit 50 is structured such that after the compacted material is supplied through a supply opening 64, the hot compacted material is cooled in the cooler 60 and stored in the storage tank 69 after passing through a left exit opening 53. Alternatively, the hot compacted material is supplied to the melter-gasifier 430 after passing through a right exit opening 55.

Although not shown, a branching plate that is operated by a hydraulic cylinder is rotatably mounted in the hot branching unit 50 such that supply of the compacted material to the left exit opening 53 or the right exit opening 55 may be controlled. The hot branching unit 50 is used, in particular, to supply the compacted material to the cooler 60 by changing the position of the branching plate in the case where a problem occurs in the melter-gasifier 430 such that the compacted material cannot be supplied or the quality of the compacted material is not suitable.

The cooler 60 cools the hot compacted material in water then supplies the same to the storage tank 69. A more detailed description of the cooler 60 is provided below with reference to FIG. 6.

Figure 6:
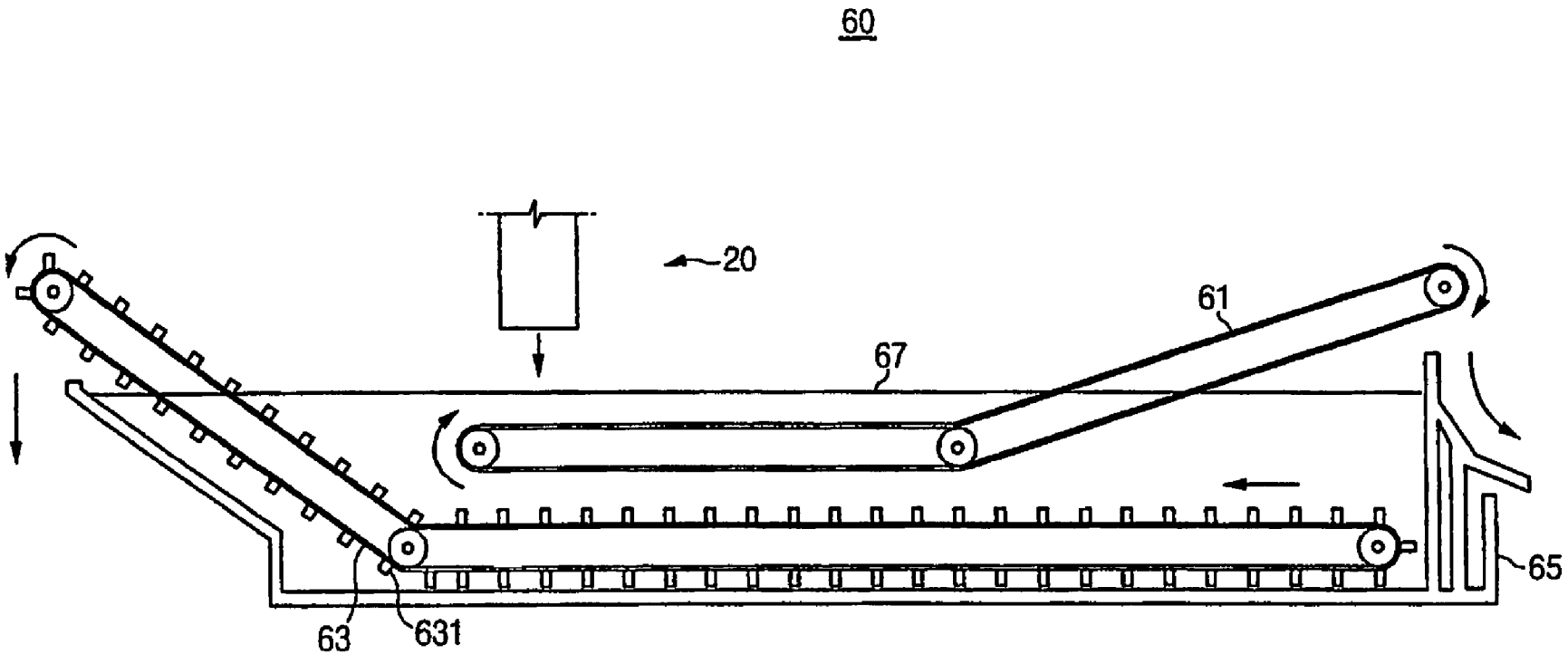
FIG. 6 is a sectional view of a cooler according to an embodiment of the invention.

FIG. 6 is a sectional view of a cooler according to an embodiment of the present invention. The cooler 60 shown in FIG. 6 includes a first conveyor 61 that receives the crushed compacted material and submerges the compacted material in water to cool the same, then transmits the cooled compacted material to the storage tank. The cooler 60 also includes a second conveyor 63 on which are mounted a plurality of blades 631 that collect crushed compacted material powder that has collected on the floor, and supply the powder to the storage tank. In addition to these elements, the cooler 60 may include various accessory devices needed to perform cooling.

The first conveyor 61 and the second conveyor 63 mounted one above and one below are operated such that a belt made of an iron plate is rotated by rollers connected to a motor. Accordingly, the compacted material is cooled by water 67 filled in a water tank 65, after which the compacted material is transferred to an external storage tank. The storage tank 69 (see FIG. 1) stores the compacted material cooled in this manner for later use.

Referring again to FIG. 1, in a normal state, the hot compacted material separated by the hot branching unit 50 is supplied to the hot separator 70 to thereby undergo a separating process. After crushing, the compacted material of a grain size of 50 mm or more, preferably 30 mm or more is separated by the hot separator 70. The hot separator 70 is able to perform separating of a maximum of 120 tons per hour. The hot separator 70 includes a screen that is vibrated to separate particles of the desired size with respect to the compacted material provided through a supply opening.

The hot separator 70 discharges compacted material of a grain size of 50 mm or more, preferably 30 mm or more, through a first discharge opening 73, and discharges compacted material that is less than this level of grain size through a second discharge opening 71. Since the compacted material is not preferable for use in the melter-gasifier if its grain size exceeds 30 mm, a second crushing process must be performed. A second crusher 80 is mounted under the first discharge opening 73 of the hot separator 70. The second crusher 80 performs crushing for a second time of the compacted material so that it is crushed to a size preferred for use in the melter-gasifier 430. Further, the hot conveying unit 90 is mounted under the second discharge opening 71 of the hot separator 70. The hot conveying unit 90 supplies the compacted material exiting the second discharge opening 71 to the melter-gasifier 430.

Although not shown, the second crusher 80 comprises two crushing rolls. After a plurality of disk blades is secured using tie bolts and with space rings interposed therebetween, the resulting assembly is rotated using a hydraulic motor. As a result, protrusions formed on the blades are mounted adjacent to one another, and the compacted material of large grain sizes passing therebetween is crushed. Distances between the blades may be altered by varying a thickness of the space rings such that the compacted material is crushed to various grain sizes. By fixing one of two crushing rolls and displacing the other horizontally using a hydraulic apparatus, the distance between the crushing rolls may be adjusted. In addition, the compacted material may also be crushed by varying the rotational speed of the hydraulic motor by adjusting the amount of oil supplied thereto.

The compacted material discharged through the second discharge unit 71 and the compacted material that is crushed a second time by the second crusher 80 are transmitted to a compacted material storage tank 95 by the hot conveying unit 90. The hot conveying unit 90 includes a plurality of sprockets mounted to a rotating shaft of a drive motor and a chain rotated by an endless track method. A bucket is connected to a pulley that is connected to the chain to transmit the compacted material to the compacted material storage tank 95.

Pressure is made equal with the melter-gasifier 430 through a plurality of hot intermediate vessels 410 mounted under the compacted material storage tank 95. Next, the compacted material is charged to the melter-gasifier 430 from the compacted material storage tank 95.

A preferable grain size distribution of the compacted material is as follows: 10 wt % or less of a grain size not exceeding 1 mm, 5~30 wt % of 1~10 mm, 10~40 wt % of 10~20 mm, 10~40 wt % of 20~30 mm, and 20 wt % of 30~50 mm. It is preferable that compacted material with an average grain size of 1~30 mm comprises 25~100 wt % of the total.

A coal packed bed comprising lump coals and shaped coals made of fine coals is formed in the melter-gasifier 430. Oxygen ($O_2$) is supplied to the coal packed bed through an outer wall of the melter-gasifier 430 to thereby manufacture molten iron.

In the molten iron manufacturing apparatus 10 according to the embodiment of the invention, if the hot compacted material makes contact with the atmosphere, there is the significant concern that heat may be generated or a fire might occur as a result of undergoing re-oxidation with oxygen. Therefore, to prevent oxidation of the compacted material; a nitrogen injection pipe for supplying nitrogen is installed to thereby perform filling of nitrogen so that oxygen density is reduced. With reference to FIG. 1, nitrogen may be supplied to elements where the compacted material has a high chance of making contact with the atmosphere, that is, to the open/close valve 15, the roller presses 30, the first crusher 40, the second crusher 80, and the hot conveying unit 90.

Figure 7:
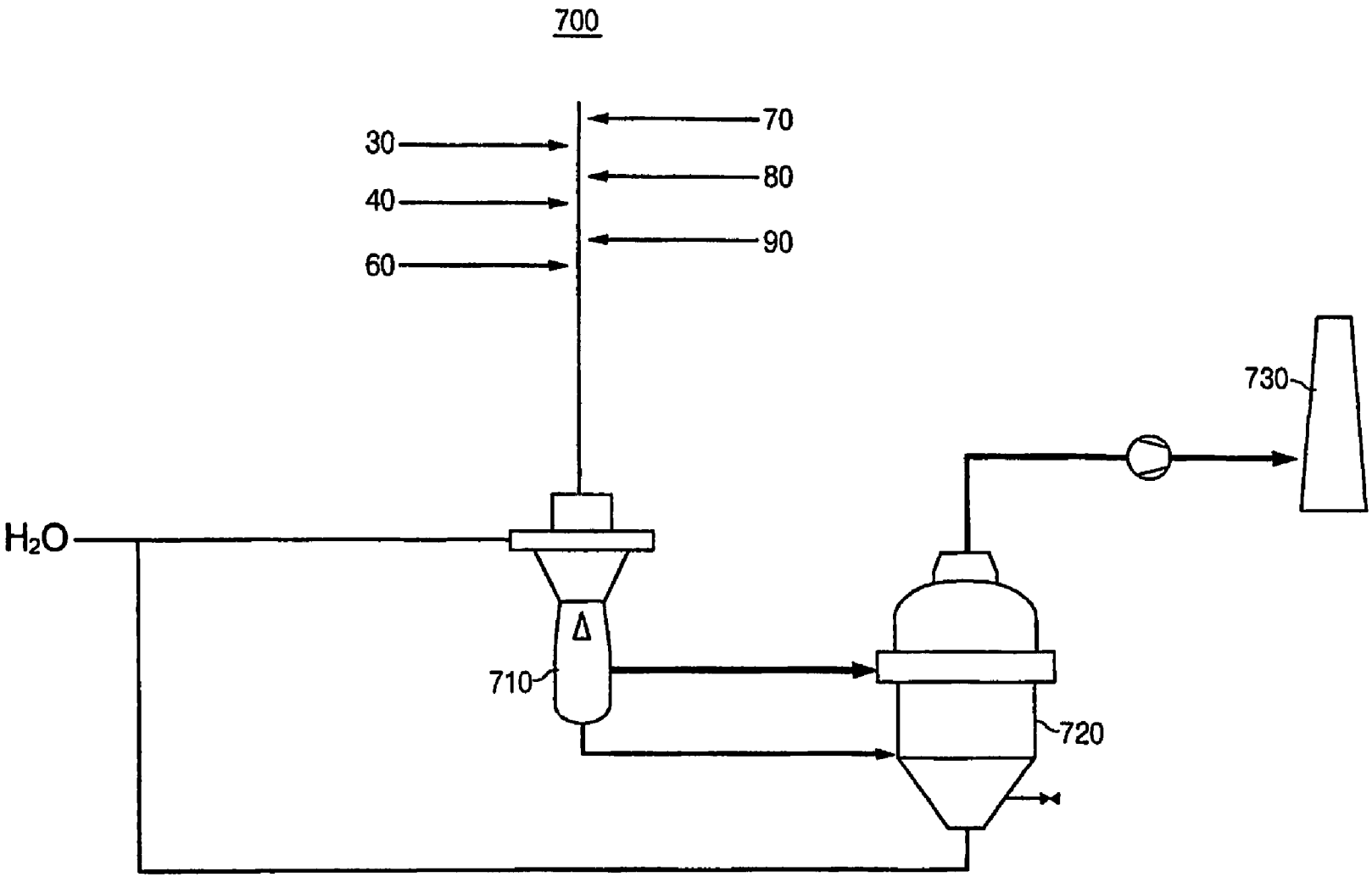
FIG. 7 is a drawing schematically showing a dust collector according to an embodiment of the invention.

FIG. 7 is a drawing schematically showing a dust collector 700 according to an embodiment of the invention.

The dust collector 700 collects hot dust particles generated during transporting, charging, crushing, and sorting processes in the apparatus for manufacturing molten iron of the present invention. The dust collector 700 shown in FIG. 7 is mounted to the roller presses 30, the first crusher 40, the cooler 60, the hot separator 70, the second crusher 80, and the hot conveying unit 90 all of FIG. 1. The dust collector 700 includes a dust collecting port (not shown) for collecting dust particles generated at each of these elements, a wet scrubber 710 for wet scrubbing dust particles collected at the dust collecting port (not shown), and a dehumidifier 720 for removing the moisture from the dust particles that are wet scrubbed by the wet scrubber 710. Following the wet scrubbing process, the dust particles are discharged through a chimney 730. In the case where compacted material is manufactured through the above method, the amount of dust particles that is generated may be reduced to less than 5%.

An experimental example of the invention is described below. This experimental example is used only to illustrate the present invention, and is not meant to be restrictive.

EXPERIMENTAL EXAMPLES

Reducing materials in which there are mixed hot fine direct reduced iron and calcined additives at approximately 750° C. and discharged from the fluidized-bed reactor were manufactured into continuous compacted material using various types of roller presses.

First Comparative Example

Figure 8:
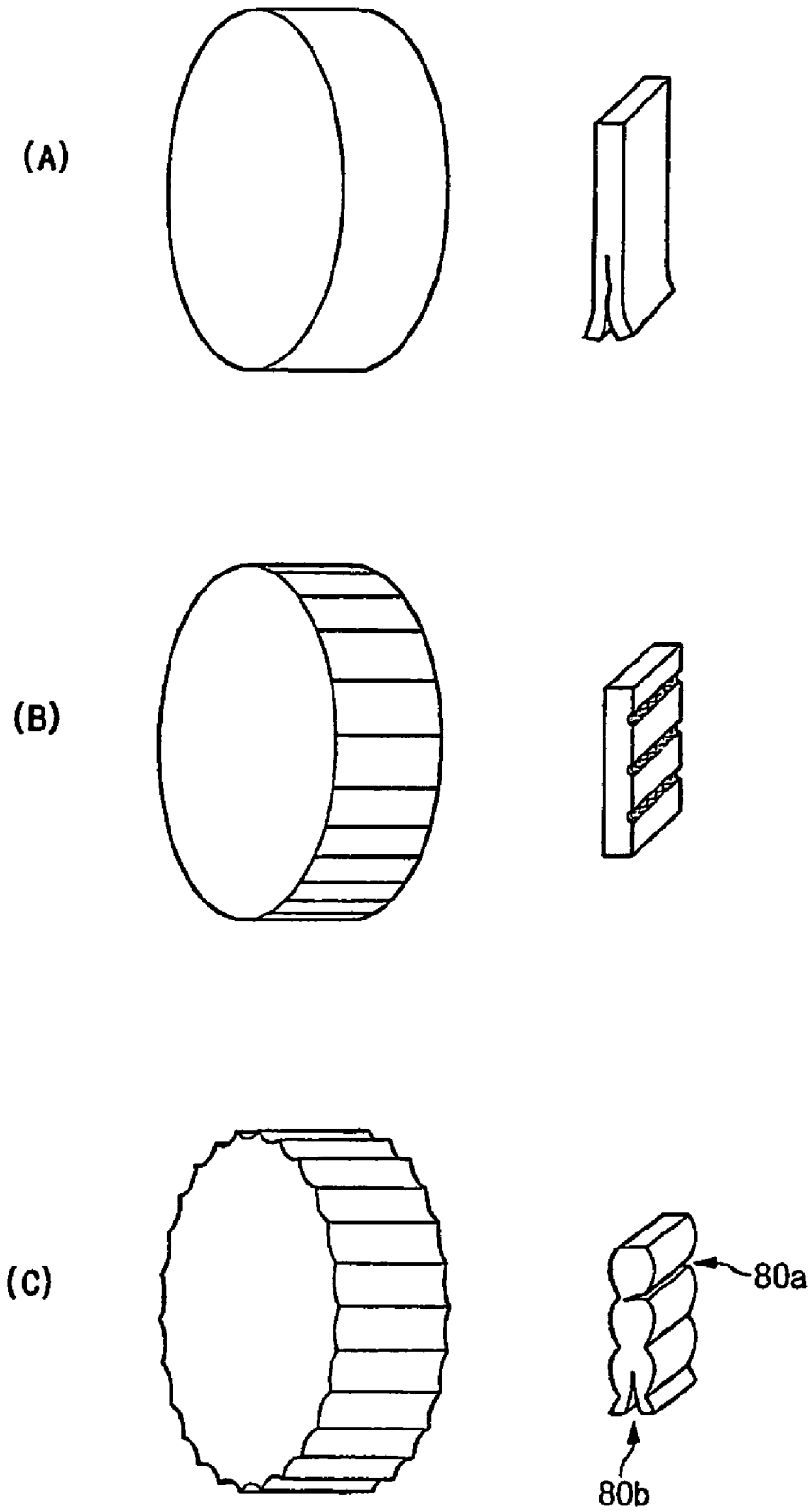
FIG. 8 is a drawing schematically showing compacted material manufactured using conventional roller presses.
Figure 9:
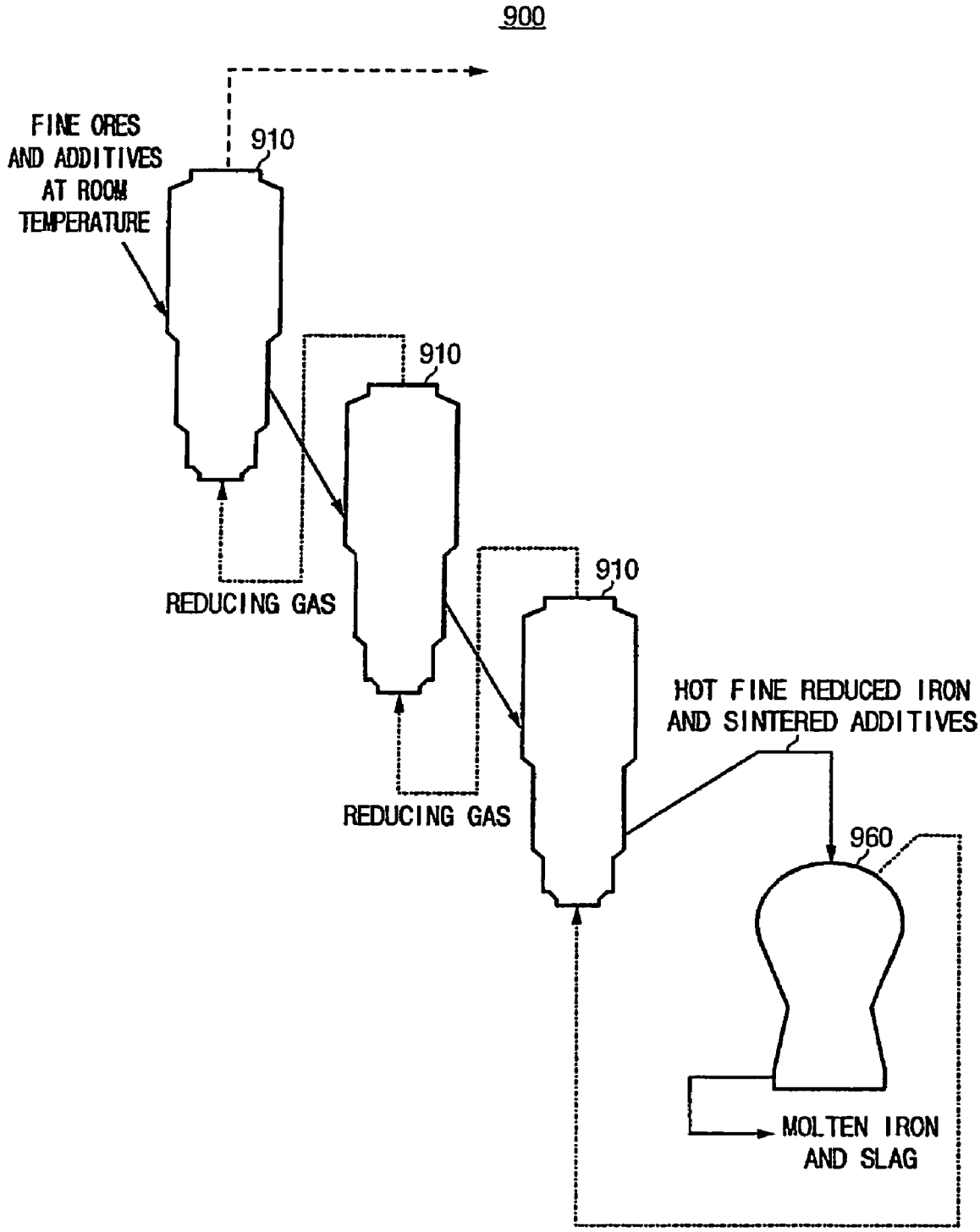
FIG. 9 is a drawing schematically showing a conventional apparatus for manufacturing molten iron.

As shown by the left illustration of A of FIG. 8, compacted material was roll pressed using roller presses having a flat surface. As a result, compacted material having a thickness of 8 mm and formed as shown by the right illustration of A of FIG. 8 was obtained. A density of the compacted material was 3.8 g/cm$^3$, and dust particles of 1 mm or less at 10 wt % were generated. Further, as shown in the right illustration of A of FIG. 8, there was observed a split along the length of the compacted material.

Second Comparative Example

As shown by the left illustration of B of FIG. 8, compacted material was roll pressed using roller presses on a surface of which there were uniformly formed grooves. As a result, compacted material having a thickness of 10 mm and formed as shown by the right illustration of B of FIG. 8 was obtained. A density of the compacted material was 3.8 g/cm$^3$, and dust particles of 1 mm or less of 8 wt % were generated. However, because of the increased adhesivity between the fine direct reduced iron and the roller presses, a split was generated.

Third Comparative Example

As shown by the left illustration of C of FIG. 8, compacted material was roll pressed using a pair of roller presses on a surface of which there were uniformly and continuously formed depressed grooves along an axial direction of the roller presses. A configuration was used in which protrusions of one of the roller presses were aligned with the protrusions of the opposing roller presses, and when operated, the roller presses manufactured compacted material with a thickness of 16 mm. A density of the compacted material was 3.8 g/cm$^3$. As shown by the right illustration of C of FIG. 8, grooves on opposite pressed sided were positioned opposing one another such that a break 80*a* was generated in the compacted material and a split 80*b* was formed along a lengthwise direction thereof.

Embodiment

With reference to FIG. 3, compacted material was roll pressed using a pair of roller presses on a surface of which there were uniformly and continuously formed depressed grooves along an axial direction of the roller presses. A configuration was used in which protrusions of one of the roller presses were unaligned with the protrusions of the opposing roller presses, that is, the protrusions of one of the roller presses were positioned between protrusions of the opposing pressing forming roll. When operated, the roller presses manufactured compacted material with a thickness of 16 mm. Further, a density of the compacted material was 3.8 g/cm$^3$, productivity was improved by 200%, and dust particles of 1 mm in size or less were 5 wt % of the total.

The above information is summarized and presented in the table below.

TABLE 1

| | Thickness | Density | Productivity | Powder generation rate | Break/Split |
|---|---|---|---|---|---|
| Embodiment | 16 mm | 3.8 g/cm$^3$ | 200% | 5 wt % | X |
| First Comparative Example | 8 mm | 3.8 g/cm$^3$ | 100% | 10 wt % | ○ |
| Second Comparative Example | 10 mm | 3.8 g/cm$^3$ | 120% | 8 wt % | ○ |
| Third Comparative Example | 16 mm | 3.8 g/cm$^3$ | — | — | ○ |

As shown in Table 1, the compacted material manufactured according to the embodiment of the invention may be produced to a thickness of 16 mm or less such that productivity was increased and the amount of powder generated was reduced. Further, in the embodiment of the present invention, no breaks or splits occurred, and the compacted material had superior properties compared to the compacted material manufactured according to the first through third comparative examples.

In the apparatus and method for manufacturing molten iron using fine coal and fine iron ore of the invention described above, a method of hot compacting fine direct reduced iron is provided to facilitate the manufacture of molten iron, and to improve efficiency and productivity. The invention also allows more flexibility with respect to equipment operation during the manufacture of compacted material.

In addition, by forming the compacted material in a state where the two roller presses are provided such that protrusions of one of two roller presses are positioned between the protrusions of the opposing roller presses, the grooves of the compacted material are unaligned on the opposite pressed surfaces to thereby prevent breaking or splitting of the compacted material. Accordingly, the roll pressed compacted material is supplied to the crusher in a continuously formed state to minimize the stress given to the crusher.

Furthermore, the roller presses according to the present invention are formed such that with respect to an arc length between tips of adjacent protrusions on the surface of the first roller press, a ratio of an arc length from one of the tips of adjacent protrusions of the first roller press to a corresponding point of the first roller press across from a tip of a protrusion of the second roller press (between the tips of the adjacent protrusions) to an arc length between the tips of adjacent protrusions of the first roller press is between 0.3 and 0.5. This prevents breaks from being formed in the compacted material.

The reducing material is charged in two slanted directions at acute angles to a direction perpendicular to the roller presses. As a result, scattering of the reducing material is prevented and the reducing material is efficiently roll pressed.

Since the thickness of the compacted material is 3~30 mm, the compacted material does not break, and an amount of the same is significant such that damage to the roller presses is not incurred.

In addition, since crushed compacted material may be bypassed, cooled, then stored, more flexibility is provided if there are problems with the melter-gasifier or defects in the compacted material.

Further, since the compacted material manufactured using the method for manufacturing molten iron of the present invention is directly used in the melter-gasifier, a density of approximately 3.5~4.2 tons/m$^3$ is sufficient to enable transport, and is such that the pressure applied to the roller presses during roll pressing is limited such that damage to the roller presses does not occur.

Although embodiments of the invention have been described in detail hereinabove in connection with certain exemplary embodiments, it should be understood that the invention is not limited to the disclosed exemplary embodiments, but, on the contrary is intended to cover various modifications and/or equivalent arrangements included within the spirit and scope of the invention, as defined in the appended claims.

What is claimed is:

1. A method of manufacturing molten iron, comprising:

producing reducing material of mixed hot fine direct reduced iron and calcined additives, the reducing material being produced from multiple fluidized beds;

charging the reducing material to at least one pair of roller presses;

roll pressing the reducing material through the at least one pair of roller presses to produce continuous compacted material having lumped portions adjacent to each other and concave grooves formed between the lumped portions on pressed surfaces;

crushing the compacted material to have irregular shapes;

subsequently charging the crushed compacted material with irregular shapes to a coal packed bed; and supplying oxygen to the coal packed bed to manufacture molten iron, wherein the lumped portions are continuously formed on the pressed surfaces along an axial direction of the at least one pair of roller presses, wherein the pressed surfaces comprise first and second pressed surfaces opposing each other and the lumped portions comprise first and second lumped portions formed on the first and second surfaces, respectively, and, wherein, when viewed from a direction perpendicular to a plane centered between the first pressed surface and the second pressed surface:

(i) the first and second lumped portions partially overlap each other; and (ii) the concave grooves are unaligned on the opposing first and second pressed surfaces.

2. The method of claim 1, further comprising charging the reducing material in two slanted directions at acute angles to a direction perpendicular to the at least one pair of roller presses.

3. The method of claim 1, wherein the compacted material has a thickness of 3 mm to 30 mm and a density of 3.5 tons/$m^3$ to 4.2 tons/$m^3$.

4. The method of claim 1, wherein the crushed compacted material has an average grain size of 50 mm or less.

5. The method of claim 1, further comprising performing a second crushing process of the crushed compacted material in the case where an average grain size of the crushed compacted material exceeds 30 mM.

6. The method of claim 1, further comprising supplying nitrogen in each step.

7. The method of claim 1, further comprising:

collecting dust particles generated in each step;

wet scrubbing the collected dust particles;

removing moisture from the wet scrubbed dust particles; and discharging the dust particles from which moisture has been removed to the outside.

8. A method for manufacturing molten iron, comprising:

producing hot fine direct reduced iron from fluidized beds;

charging the fine direct reduced iron to at least one pair of roller presses;

roll pressing the fine direct reduced iron through the at least one pair of roller presses to produce continuous compacted material having lumped portions adjacent to each other and concave grooves formed between the lumped portions on pressed surfaces;

crushing the compacted material to have irregular shapes;

subsequently charging the crushed compacted material with irregular shapes to a coal packed bed; and supplying oxygen to the coal packed bed to manufacture molten iron, wherein the lumped portions are continuously formed on the pressed surfaces along an axial direction of the at least one pair of roller presses, wherein the pressed surfaces comprise first and second pressed surfaces opposing each other and the lumped portions comprise first and second lumped surfaces formed on the first and second surfaces, respectively, and wherein, when viewed from a direction perpendicular to a plane centered between the first pressed surface and the second pressed surface:

(i) the first and second lumped portions partially overlap each other; and (ii) the concave grooves are unaligned on the opposing first and second pressed surfaces.

9. The method of claim 8, wherein a ratio of an arc length between corresponding point of the first pressed surface corresponding to a groove of the second pressed surface and at least one groove of the adjacent grooves of the first pressed surface, to an arc length between adjacent grooves of the first pressed surface is between 0.3 and 0.5.

10. The method of claim 8, further comprising mixing hot calcined additives from multiple fluidized beds with the fine direct reduced iron and performing each step.

11. The method of claim 10, wherein the calcined additives are 3 wt % to 20 wt % of the total compacted material.

12. The method of claim 10, comprising roll pressing the fine direct molten iron at a temperature of 400° C. to 800° C. by the at least one pair of roller presses.

13. The method of claim 10, comprising roll pressing the fine direct molten iron at 140 bar to 250 bar by the at least one pair of roller presses.

14. The method of claim 10, wherein the continuous compacted material has a thickness of 3 mm to 30 mm and a density of 3.5 tons/$m^3$ to 4.2 tons/$m^3$.

15. The method of claim 10, wherein the crushed compacted material has an average grain size of 50 mm or less.

16. The method of claim 15, wherein the average grain size of the crushed compacted material is 30 mm or less.

17. The method of claim 10, wherein the crushed compacted material with a grain size of 1 mm to 30 mm comprises 25 wt % to 100 wt % of the total.

* * * * *